US005498354A

United States Patent [19]

Graham et al.

[11] Patent Number: 5,498,354

[45] Date of Patent: Mar. 12, 1996

[54] HIGH TEMPERATURE LUBRICATION METHOD FOR METAL AND CERAMIC BEARINGS

[75] Inventors: Edgar E. Graham, Lyndhurst; Wilfredo Morales, Lorain, both of Ohio

[73] Assignee: Cleveland State University, Cleveland, Ohio

[21] Appl. No.: 318,445

[22] Filed: Oct. 5, 1994

[51] Int. Cl.[6] ..... C10M 105/72

[52] U.S. Cl. ..... 252/48.2; 252/12

[58] Field of Search ..... 252/12, 48.2, 45; 184/6.22, 109

[56] References Cited

U.S. PATENT DOCUMENTS 3,844,961 10/1974 Clark ..... 252/46.7

3,844,962 10/1974 Clark ..... 252/46.7

*Primary Examiner*—Prince Willis, Jr.

*Assistant Examiner*—Cephia D. Toomer

*Attorney, Agent, or Firm*—John F. McDevitt

[57] ABSTRACT

Metal and ceramic bearing means being operated at elevated temperatures of at least 300° C. and higher under various atmospheric conditions are effectively lubricated with a novel class of vapor-phase deposited polymer lubricants. The lubricants are formed in-situ during bearing operation and are formed starting with various polyphenyl thioether compounds.

7 Claims, 2 Drawing Sheets

HIGH TEMPERATURE LUBRICATION METHOD FOR METAL AND CERAMIC BEARINGS

BACKGROUND OF THE INVENTION

This invention relates generally to lubrication means enabling both metal and/or ceramic bearing surfaces to resist mechanical wear at elevated operating temperatures of at least 300° C. and higher, and more particularly to employing an improved source of lubrication as the means for doing so.

Lubrication is a well recognized means to reduce friction and wear between bearing surfaces in dynamic physical contact. As such, a pair of load bearing surfaces having relative movement therebetween will be in rolling or sliding contact, as well as combinations thereof, which can include a wide variety of known structural articles such as journal bearings, piston rings, gears, cams and the like. Two major areas for which improved lubricants are needed for continued progress at elevated temperatures are metal forming and transportation. Better metal forming capabilities to minimize machining and grinding require lubrication techniques and lubricants that can be used effectively at temperatures approaching the melting points of the metals now being used. In transportation, one of the most productive areas for increasing energy efficiency is often referred to as high temperature engines wherein temperatures range from 300° C. and above making the selection of lubricants and means of lubrication difficult. In other known bearing applications high bearing contact pressures of 70,000 PSI are experienced making lubrication most difficult with existing lubricant systems. A known technique for lubrication at such high bearing temperatures and pressures is the use of solid lubricants in the form of plasma sprayed coatings of the metals and ceramics being employed.

Various organic lubricants which are applied as liquids at elevated temperatures of bearing operation are already known. For example, a published article entitled "Properties of a New Class of Polyaromatics for Use as High-Temperature Lubricants and Functional Fluids" ASLE Transactions Volume 9, Issue 1, pages 13–23 reports development of organic liquids for lubrication at elevated temperatures to include polyphenyls, polyphenyl ethers and polyphenyl thioethers. Subsequent investigations employing the latter lubricant are further reported in NASA Publications entitled "Formulation and Evaluation of C-Ether Fluids as Lubricants Useful to 260° C." dated Dec. 16, 1980 and NASA Technical Memorandum 83474 entitled. "High Pressure Liquid Chromatography: A Brief Introduction, and Its Application in Analyzing the Degradation of a C-ether (Thioether) Liquid Lubricant" dated Sep. 1983. In both NASA publications, degradation of the starting thioether lubricant was found to occur at elevated temperatures of bearing operation, however, limiting the use temperature of this lubricant to no greater than 260° C.

More recent developments whereby a polymeric lubricating film is deposited on both ceramic and metal bearing surfaces from a vaporized polymer-forming organic reactant is also now known. For example, a tenacious polymer lubricating film is disclosed in U.S. Pat. No. 5,139,876 upon treating ceramic bearing surfaces during operation at elevated temperatures of at least 300° C. with vaporized organic reactants such as petroleum hydrocarbon compounds, mineral oils, various synthetic lubricants and to further include tricresyl phosphate (TCP) and triphenyl phosphate. In a still more recently issued U.S. Pat. No. 5,351,786, there is further disclosed lubrication means for such operation of these bearing devices with polymer lubricants formed in-situ upon vapor-phase deposition of various phosphazene compounds. For the vapor-phase lubrication of ceramic bearing surfaces in such manner, it has also been found that formation of the desired polymer lubricant can possibly be further enhanced by ancillary means. Accordingly, U.S. Pat. No. 5,139,876 discloses formation of the lubricating film after first treating the uncoated ceramic surface at elevated temperatures with activating metal ions comprising a transition metal element selected from the Periodic Table of Elements to include iron and tin. There is similarly disclosed in U.S. Pat. No. 5,163,757 a lubrication means for ceramic bearing devices utilizing metal oxide lubricants formed during bearing operation. As therein disclosed, continuous lubrication of the ceramic bearing surfaces is provided with solid metal oxide lubricants formed in-situ with an oxidizable metal source located in physical proximity to the ceramic bearing surfaces being treated. A representative lubrication system enabling such mode of operation includes (a) support means causing the ceramic bearing surfaces to be maintained in dynamic physical contact, (b) an oxidizable metal source located in physical proximity to the support means, and (c) heating means for continuously heating the metal source while the ceramic bearing surfaces are being operated sufficient to provide the solid metal oxide lubricants. In one embodiment, the ceramic bearing means employs ceramic ball bearings supported within a ceramic race with a metal housing member enclosing the bearing structure. Utilizing oxidizable metals for construction of said housing member, including molybdenum and iron alloys, provides a suitable metal source in sufficient physical proximity to the bearing surfaces for satisfactory lubrication at the aforementioned operating conditions. Since it is expected that vapor-phase lubrication with the present lubricants can likewise be enhanced utilizing the same or similar ancillary means, the entire contents of both 5,139,876 and 5,163,757 prior art patents are hereby specifically incorporated by reference into the present application.

It remains desirable to provide lubrication of both metal and ceramic bearing means when operated at these elevated temperatures under various atmospheric conditions by still more effective means. Accordingly it is one object of the present invention to provide improved lubrication means for various type mechanical apparatus utilizing either metal or ceramic bearing materials, including combinations thereof, under such operating conditions.

It is another object of the present invention to provide means for continuous lubrication of metal and ceramic bearing surfaces with a novel class of vapor-deposited polymer lubricants formed in-situ.

A still further object of the present invention is to provide a novel method for the lubrication of metal and/or ceramic bearing surfaces at relatively low lubricant levels with vapor-phase deposited lubricants.

These and further objects of the present invention will become more apparent upon considering the following detailed description of the present invention.

SUMMARY OF THE INVENTION

It has now been discovered, surprisingly, that a more effective lubrication means can be provided for a mechanical apparatus employing at least one pair of moving bearing surfaces being operated in dynamic physical contact to resist mechanical wear of said bearing surfaces at elevated operating temperatures of at least 300° C. More particularly, both reduction of the friction coefficient and reduction of surface wear is now provided with a novel class of polymer lubricants vapor-deposited during atmospheric bearing operation at such elevated temperatures. Such improved bearing operation results upon introducing a vaporized polyphenyl thioether starting lubricant which thereupon initiates polymerization in the vapor-phase to form a polymer lubricating film on one or more of the operating bearing surfaces. Both metal and ceramic bearing means can be operated in this manner with little wear occurring over relatively lengthy time periods while such lubricants are being continuously applied. A temporary interruption of the present lubrication means during bearing operation and for time periods exceeding thirty minutes was also found not to produce bearing failure as distinct from using still other known vapor-phase formed polymer lubricants. Generally, the presently improved bearing lubrication requires (a) treating the bearing surfaces during operation at elevated temperatures of at least 300° C. with an atmospheric mixture containing a polymerizable polyphenyl thioether, and (b) polymerizing the vaporized polyphenyl thioether in the vapor-phase while in contact with the operating bearing surfaces to form a vapor-deposited adherent polymer lubricating coating in-situ on at least one of the treated bearing surfaces. A typical mechanical apparatus employing the present lubrication means to resist wear occurring between a pair of moving bearing surfaces being operated in dynamic physical contact requires (a) support means causing the bearing surfaces to be maintained in dynamic contact, (b) a supply source of the vaporizable polyphenyl thioether, including mixtures thereof, and (c) heating means to vaporize the thioether in an atmospheric mixture causing the vaporized thioether to polymerize and form an adherent polymer lubricating coating on at least one of the bearing surfaces while being operated in dynamic physical contact at elevated temperatures of at least 300° C. In doing so, relatively low concentrations of the selected thioether compound or compounds become vaporized in a suitable carrier gas, such as air, for deployment in lubricating amounts to the operating bearing surfaces. Satisfactory introduction of the vaporized mixture can be carried out at atmospheric conditions as well as various other operating conditions needed for a satisfactory introduction. Subsequent polymerization of the introduced thioether component in said mixture thereupon becomes initiated in the vapor-phase to produce an adherent solid polymer lubricating coating on the treated bearing surfaces when examined at ambient conditions. For example, solid polymer lubricants produced in such manner were found to have molecular weights of at least 30,000.

Suitable thioether starting materials for employment in accordance with the present invention can be selected from the class of vaporizable non-polynuclear aromatic thioether compounds generally made available commercially as liquid mixtures of several individual compounds, to include 1,1-thiobis-(3-phenoxybenzene); 1-phenoxy-3[3-(phenylthio)phenyl] thiobenzene; 1,1-thiobis-[3-(phenylthio) benzene; and 1,3-bis-(phenylthio) benzene. Representative thioether starting materials already found suitable in the practice of the present invention are still further described in the previously cited ASLE publication both with respect to physical properties and performance characteristics when utilized only as liquid lubricants. In accordance therewith, typical liquid lubricant mixtures of said thioether starting materials are reported to range in viscosity between 4–2,000 centipoises at ambient conditions along with thermal stability up to 700° F. and oxidation stability up to 550° F.

DETAILED DESCRIPTION OF THE PREFERRED EMBODIMENTS

Figure 1:
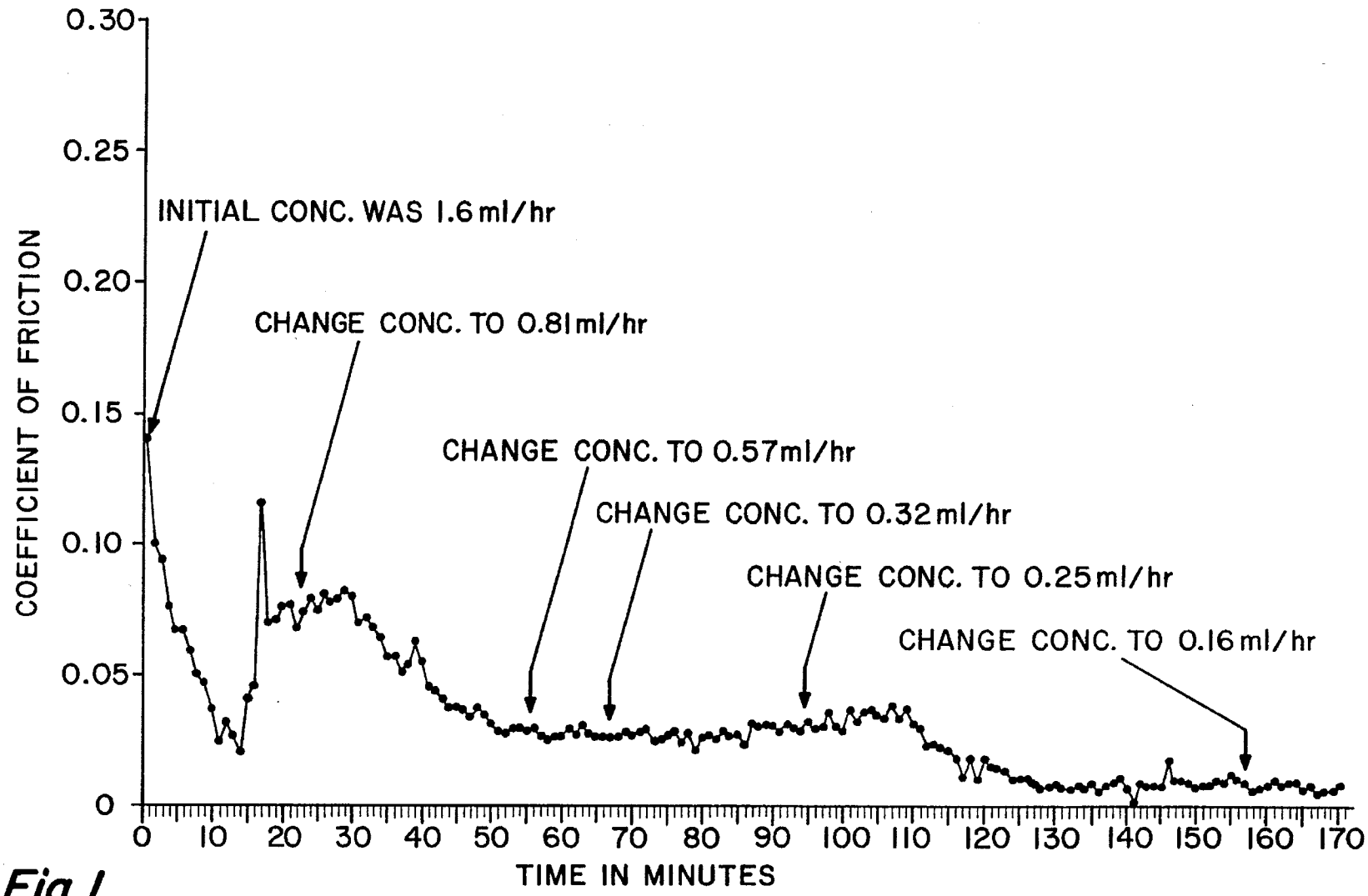
FIG. 1 is a graph providing friction force measurements obtained with various applied lubricant amounts for a particular lubrication means of the present invention.
Figure 2:
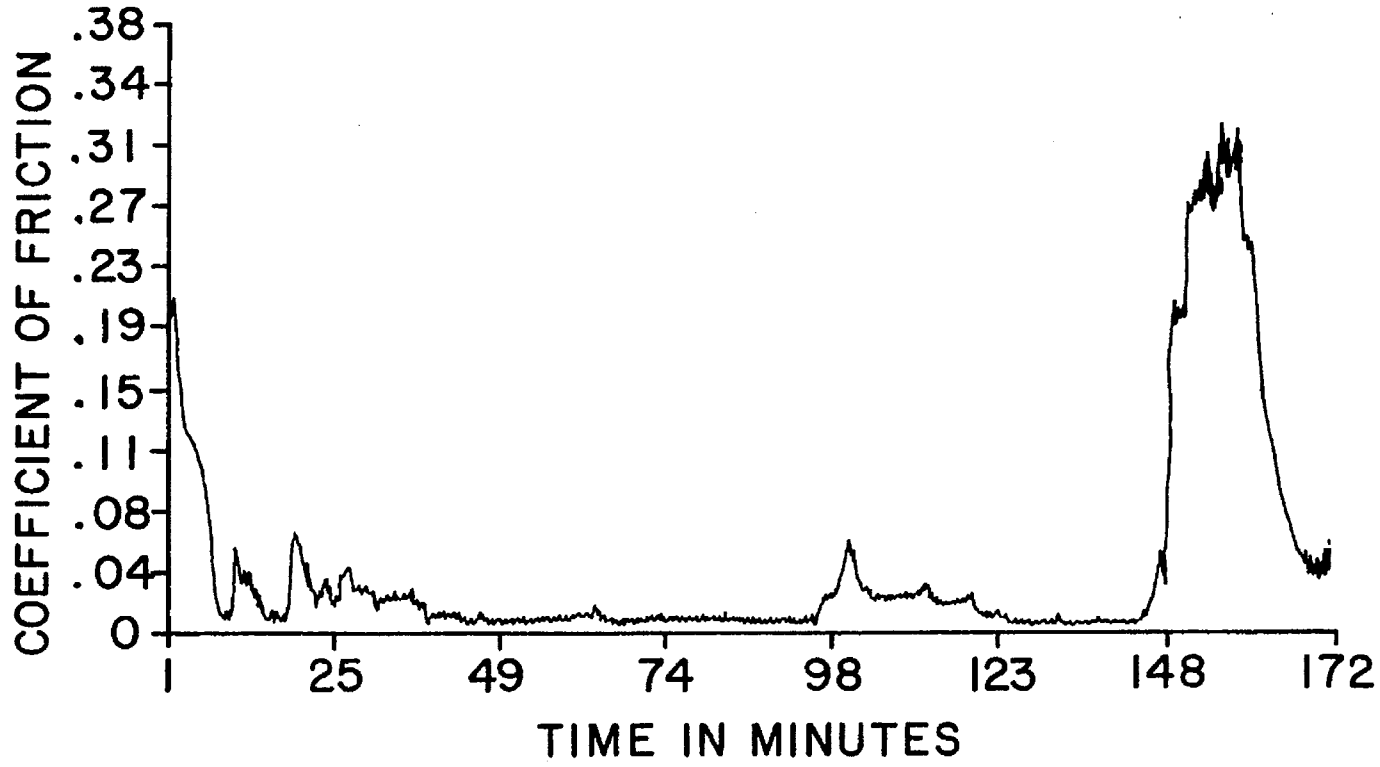
FIG. 2 is a graph enabling a comparison to be made of the bearing wear characteristics for the same lubrication means of the present invention employed in preceding FIG. 1.

Referring to the drawings, there is reported in FIG. 1 the friction force measurements carried out during operation of a conventional tribometer employing a stationary iron rod loaded with a four kilogram mass to generate contact pressures of approximately 1.2 MPa against a reciprocating cast iron plate. A plate temperature of 500° C. was maintained during the reported test measurements while various concentrations of the lubricant vapor were applied at a temperature of approximately 400° C. during the time period reported on the abscissa of said graph. The starting lubricant being employed consisted of a 0.014 weight percent concentration polyphenyl thioether mixed in air which was applied at the varying rates of liquid polyphenyl thioether that are also listed on said graph. In response thereto, a thin polymer lubricating film was deposited at the wearing contact during all said test measurements with friction coefficients being measured as low as 0.01. As can also be noted from said graph, lower friction coefficients were obtained at lower lubricant levels which is not customary for conventional liquid lubrication systems. An additional benefit observed from said test measurements was absence of any detectable wear on the test plate.

A still further test evaluation was conducted employing the particular lubrication means identified in the preceding FIG. 1 embodiment. Specifically, friction coefficients were again measured over the test period reported on the abscissa of said graph for the same starting lubricant mixture when employed under the same test conditions at a rate of 1.2 milliliters of liquid polyphenyl thioether per hour being employed in an air mixture while being supplied at approximately 2000 cc's per minute. Such lubrication was thereafter interrupted during the test period while measuring friction coefficients after suspending flow of the previously furnished liquid thioether lubricant while bearing operation continued. As can be noted from said graph, such suspension of the thioether lubricant at about 98 minutes into the test run produced only a modest rise in the friction coefficient to no more than about 0.06 over more than a succeeding 30 minute interval of bearing operation. From said observation it can be appreciated that bearing failure will not occur immediately should there be an accidental suspension of the present lubrication means. As distinct therefrom, immediate bearing failure is generally experienced upon interruption of other tested vapor-phase lubrication means. While the graph further depicts an unacceptable rise in friction coefficients at the 148 minute interval of said test run, it was again observed following run termination that no detectable wear had been experienced on the test plate.

It will be apparent from the foregoing description that broadly useful and novel means have been provided to continuously lubricate various type metal and/or ceramic bearing surfaces when operated under various atmospheric conditions at extremely elevated temperatures of at least 300° C. and higher. It is contemplated that such improved lubrication can likewise be obtained with a broad range of load bearing constructions in rolling and/or sliding contact other than above specifically illustrated, however, to include both ball and roller devices as well as apparatus employing gears, cams, piston rings and like devices. Likewise it is contemplated that enhancement of resistance to bearing surface wear provided with the present lubrication means can possibly be further improved utilizing the ancillary means described in the previously cited patents specifically incorporated herein. Substituting still other metal and ceramic materials than herein described for construction of the various bearing articles could also desirably lower lubricant levels for the present lubrication means while possibly further decreasing bearing surface wear at these elevated temperatures. Consequently, it is intended to limit the present invention only by the scope of the appended claims.

What we claim as new and desire to secure by Letters Patent of the United States is:

1. A method of reducing mechanical wear between a pair of moving bearing surfaces constructed of material selected from the group consisting of metals, ceramics, and combinations thereof said bearing surfaces being operated in dynamic physical contact at elevated temperatures of at least 300° C. comprising:

(a) heating a supply of a vaporizable polyphenyl thioether sufficiently to cause its vaporization, and (b) treating the bearing surfaces during operation at elevated temperatures of at least 300° C. with the vaporized polyphenyl thioether causing it to polymerize in the vapor phase while in contact with the operating bearing surfaces and form a vapor-deposited adherent polymer lubricating coating in-situ on at least one of the treated bearing surfaces.

2. The method of claim 1 wherein the bearing surfaces being treated are constructed of a metal material.

3. The method of claim 1 wherein the bearing surfaces being treated are constructed of a ceramic material.

4. The method of claim 1 wherein the bearing surfaces being treated are constructed of a metal material and a ceramic material.

5. The method of claim 1 wherein an oxidizable metal source is located in physical proximity to the bearing surfaces being treated promotes polymerization of the vaporized polyphenyl thioether.

6. The method of claim 1 wherein the lubricating coating formed comprises a solid polymer at ambient conditions having a molecular weight of at least 30,000.

7. The method of claim 1 wherein the bearing surfaces are operated in air.

* * * * *